United States Patent [19]

Cutts

[11] Patent Number: 4,482,605

[45] Date of Patent: Nov. 13, 1984

[54] SIZED TEXTILE YARN FOR WEAVING

[76] Inventor: William H. Cutts, P.O. Box 748, Clemson, S.C. 29631

[21] Appl. No.: 380,703

[22] Filed: May 21, 1982

Related U.S. Application Data

[63] Continuation-in-part of Ser. No. 208,538, Nov. 20, 1980, Pat. No. 4,364,157.

[51] Int. Cl.[3] ..... D02G 3/00

[52] U.S. Cl. ..... 428/375; 57/250; 57/251; 428/288; 428/394; 428/395

[58] Field of Search ..... 428/375, 394, 395, 296, 428/288, 290; 57/250, 251, 232, 234; 427/285, 288, 428, 389.9, 384

[56] References Cited

U.S. PATENT DOCUMENTS

| | | | |
|---|---|---|---|
| 1,909,192 | 5/1933 | Taylor | 57/251 |
| 2,007,183 | 7/1935 | Dickie et al. | 57/250 |
| 2,686,137 | 8/1954 | Rossin et al. | 57/250 X |
| 2,953,476 | 9/1960 | Armstrong | 427/428 |
| 3,941,897 | 3/1976 | Vecchia | 427/428 X |
| 3,990,132 | 11/1976 | Illman et al. | 427/428 |

*Primary Examiner*—Lorraine T. Kendell
*Attorney, Agent, or Firm*—Cort Flint

[57] ABSTRACT

A sized textile warp yarn A for weaving on a loom is disclosed which includes a size coating S carried by fibers 26 on only one side 22 of the yarn bundle B.

7 Claims, 5 Drawing Figures

SIZED TEXTILE YARN FOR WEAVING

This is a continuation-in-part of co-pending application Ser. No. 208,538, filed Nov. 20, 1980 entitled APPARATUS AND METHOD FOR APPLYING SIZING TO WARP YARNS, which has now issued into U.S. Pat. No. 4,364,157 on Dec. 21, 1982.

BACKGROUND OF THE INVENTION

The invention relates to a textile yarn which has been coated with a size coating to give the yarn better weavability in the subsequent process of weaving fabric on a loom. Typically, the warp yarns are subjected to a sizing process on a textile slashing machine prior to being woven whereupon a protective coat of size is applied to the individual threads or fibers of the yarn to cement the threads together and prevent chaffing and breaking during weaving.

In the conventional sizing process, the warp yarn ends are passed under an immersion roll and totally immersed in a sizing solution in a slasher box where the individual fibers in each warp yarn end absorb the sizing solution. The yarns are then passed to the nip of a pair of pressure rolls where the excess sizing is squeezed out of the yarn and rolled back into the sizing box. It has also been known to pass the warp yarns directly to the nip of the rollers where the sizing fluid is carried by a bottom application roll and pressure exerted by an upper pressure roll in contact with the application roll squeezes the surplus of sizing liquid out of the yarn and retains the surplus at the nip whereupon it goes back to the tank (U.S. Pat. No. 1,822,425). In both cases, however, the object is to thoroughly soak and encapsulate the warp yarn ends with the sizing solution.

Since the primary consideration in applying a size coating to a warp yarn is to eliminate warp breaks during weaving, it has always been thought that total soaking and encapsulation of all the fibers in the yarn to increase the fiber-to-fiber cementing was required to provide sufficient tensile strength and prevent warp breaks during weaving. The use of two size boxes on a slasher machine has even been proposed where the yarn is passed successively through each box to pick up a heavier film coating or greater quantity of size to hold the yarn fiber bundle together.

However, the problem occurs that considerable amounts of energy are required to dry the yarn since the sizing must be in solution with a large part of water in order to soak the yarn bundle. The water must then be subsequently squeezed and dried out of the yarn. In addition, when the yarn is encapsulated and soaked, the yarn picks up sizing in proportion to its absorption capacity which means that the thicker yarn sections pick up more size than the thin sections. This results in the yarn remaining at ununiform strength since the thick sections retain more size and strength over the thin sections. During weaving, the warp yarn breaks at the thin section.

Accordingly, an important object of the present invention is to provide a sized yarn which provides good weavability but requires less energy to produce.

Yet another important object of the present invention is to provide a sized yarn having an increased tensile strength to reduce the number of warp breaks during weaving and hence increase the production of woven fabric.

Yet another important object of the present invention is to provide a sized yarn which has a more nearly uniform tensile strength such that the weak spots are diminished and the number of warp breaks reduced.

SUMMARY OF THE INVENTION

It has been found, contrary to what might be expected, that a sized yarn can be produced having good weavability characteristics by concentrating the size coating on one side of the yarn only and cementing at least some of the individual threads in the yarn together on the one side. The size coating is applied to the one side of the yarn by applying a metered amount of sizing to the one side of the yarn per unit length of the yarn such that the thin sections receive a larger percentage of sizing according to their weight as do the individual threads in the thick spots. Thus, a sized yarn having a more nearly uniform strength is produced.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
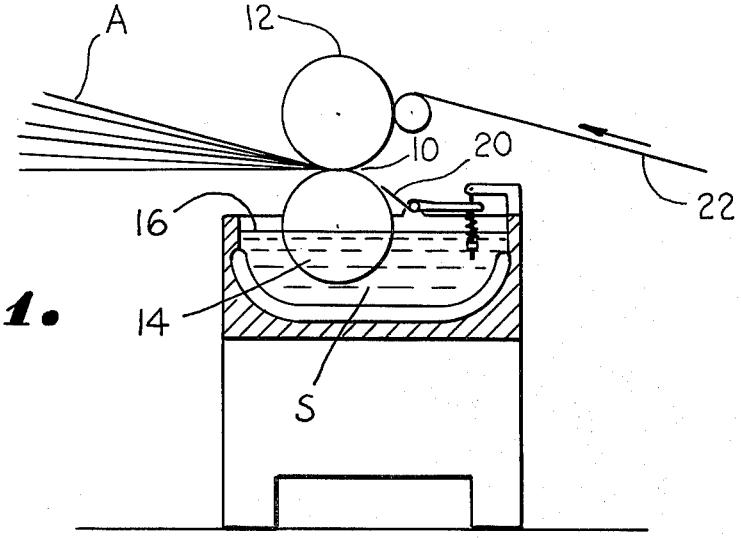
FIG. 1 is a schematic view illustrating apparatus and a process for producing a sized yarn according to the invention.

A sized yarn is disclosed which has been coated with size by applying a concentrated, metered amount of size solution to one side only of the yarn. The schematic illustration of FIG. 1 illustrates sizing apparatus and process wherein the individual warp yarns A are fed side-by-side in a generally flat sheet configuration to the nip 10 of a pair of rolls 12 and 14. The bottom roll 14 is an application roll which is partially immersed in a size box 16 which contains a concentrated sizing solution S. The sizing solution is picked up by the application roll 14 and metered by means of a doctor blade assembly 20 which removes the excess sizing solution from the application roll prior to the sizing solution reaching the nip of the rollers. The sizing is then pressed into the individual yarns A from a side 22 of the yarns at the nip of the rollers whereupon the warp yarns A are passed to a dryer (not shown). Each yarn end A has a side 22 generally facing application roll 14 as the individual warp yarn ends pass between the nip 10 of the rolls whereby the size is pressed into the fibers on this side of the yarn bundle and is dispersed and dissipated through the fibers on this side. The apparatus and process for applying the sizing to the warp yarns may be that disclosed in applicant's co-pending application entitled APPARAUS AND METHOD FOR APPLYING SIZING TO WARP YARNS, Ser. No. 208,538, filed on Nov. 20, 1980 which has now issued into U.S. Pat. No. 4,364,157, issued on Dec. 21, 1982 and this entire disclosure is hereby incorporated by reference.

Figure 2:
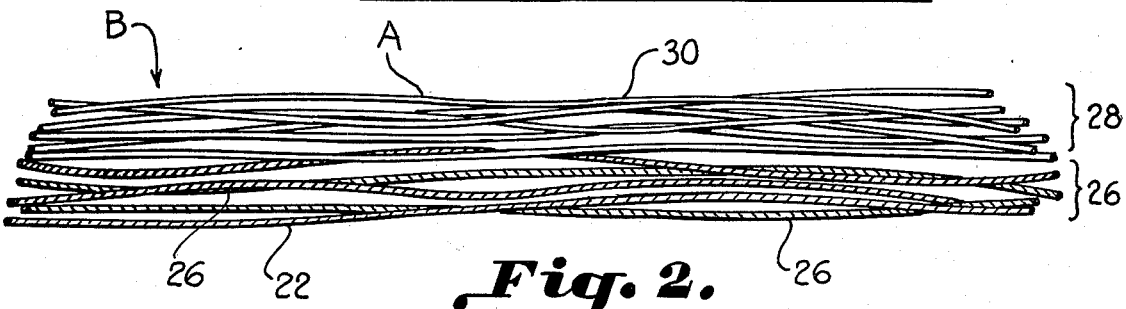
FIG. 2 is a schematic illustration of a sized yarn according to the invention with the fibers coated with size shown in color.

Referring now to FIG. 2, a sized yarn A is illustrated according to the invention which consists of a bundle of individual fibers or threads, designated generally as B, which may be filament (continuous) or spun fibers. As can be seen, only the yarns 26 on the side 22 of the yarn, which faces application roll 14 and into which the metered amount of size is pressed during application, actually carry the size coating such as to cement at least some of the individual fibers together generally on this side. The sizing is dispersed through the cross-section of the yarn bundle beginning at the side from which it is pressed into the bundle and diminishes through the yarn bundle. The fibers 28 on the other side 30 of the yarn end A contain no discernable amount of size coating. In some trial runs, the sizing effect is believed to have been dissipated at about midway through the yarn bundle thickness. While the fibers 26 are illustrated as coated with size, it is to be understood that in actuality the size would also appear between yarns as cementing these fibers together.

Figure 2A:
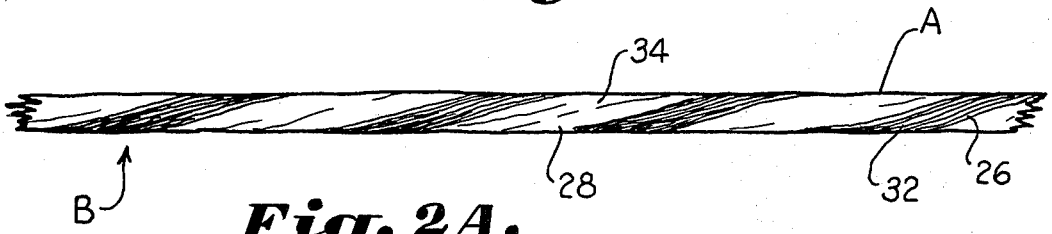
FIG. 2*a* is a schematic view illustrating the sized yarn of FIG. 2 in a twisted configuration with the colored sized fibers creating a barber-pole affect.

FIG. 2*a* illustrates the yarn A which is twisted with the sized fibers 26 being colored. The result is a barber pole affect due to the one-sided nature of the size coating wherein the sized fibers 26 are colored and form a colored spiral stripe at 32 and the unsized fibers 28 are uncolored and form another spiral stripe at 34. FIGS. 2 and 2*a* represent actual photographs taken of a sized filament yarn coated with size according to the invention wherein a colored dye was added to the size but which would not dye the polyester filament fibers. Thus, the coated fibers are colored and the uncoated fibers are uncolored.

It is thought that the almost equal width or uniformity of the stripes 32, 34 indicate that the size penetrates the fibers of the yarn bundle approximately halfway through the bundle. In other words, the affects of the size coating has dissipated at this point and no discernable size is present in fibers 28 at the other half side 30 of the bundle.

In practice, a sizing solution containing twenty to eighty percent solids is utilized whereby the amount of water in the solution is decreased considerably resulting in decreased energy consumption during drying. Trial runs have been made utilizing twenty-five percent solids requiring only three parts of water are required to one part solids in the sizing solution. In prior conventional sizing processes, nine parts of water to one part of solids is typically utilized meaning that ninety percent of the weight is water which must be removed by drying. A more detailed description of a concentrated sizing solution and effects thereof may be had by reference to applicant's co-pending application incorporated hereinabove.

It has been found that the yarn sized according to the invention has good weavability characteristics and has actually reduced the number of warp breaks during weaving in certain trial production runs of certain fibers using twenty-five percent solids. By concentrating the size on one side of the yarn, the yarn is made stronger since the fibers which are cemented must break before the unsized fibers rupture.

Figure 3:
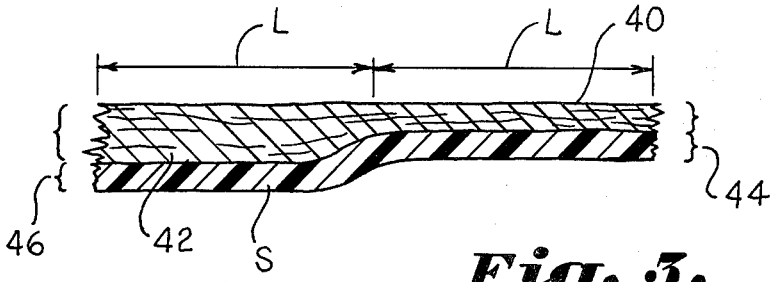
FIG. 3 is a schematic view illustrating the uniform strength characteristics of a sized yarn according to the invention.

As illustrated schematically in FIG. 3, a thin section 40 in the yarn A receives more size per weight of fibers in the section than do the fibers in a thick section 42 since a given amount of size is metered and pressed into the yarn per unit length, L, of the yarn. This renders the yarn more nearly uniform in tensile strength whereby yarn breaks at the thin weak spots are substantially eliminated. For example, the thin section 40 is illustrated schematically as being coated with a layer 44 of size which may correspond to a fifty percent pick up of solid sizing per weight of the fibers in this section. Thick section 42 picks up size 46 which is the same amount as size 44 over the length L but which may correspond only to about one-third of the size per weight of fibers in section 42, there being more fibers present in this section and only a given amount of size. Hence, the strength of the thin spot is increased proportionately over that of the thick section by the size coating and process herein.

Figure 4:
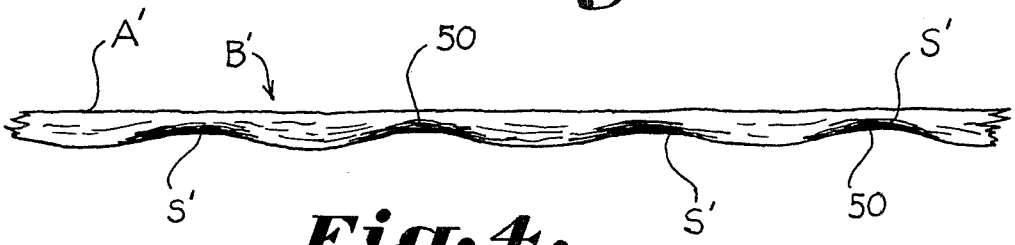
FIG. 4 is a schematic view of another sized yarn according to the invention wherein the yarn has been sized to create a spot-welded affect.

It has also been found that a sized yarn A' having a spot-welded affect is advantageous in some applications wherein size S' is applied at spaced intervals along the length of yarn A' to cement or weld fibers together at points 50 along the length of yarn bundle B' (FIG. 4). This may be done by patterning the application roll 14 such that size is deposited only at the spots 50 which is within the knowledge of one skilled in the roll etching and patterning art. For example, a fluted roll having diagonally extending grooves may be utilized wherein the lands are sufficiently wide to space the grooves so that size is applied only at intervals along the yarn.

This form of sizing may be suitable for certain types of yarn and weaving applications and thus reduce the amount of sizing applied as well as energy requirements in the subsequent drying process. This form of sizing may be particularly suitable for spun yarns which are normally twisted fifteen turns per inch. Spot sizing or welding the yarn at intervals will tie down these fibers in teh yarn bundle sufficiently to prevent them from being pulled out. For example, the grooves of the fluted roll may be spaced every one thirty-second of an inch.

While a preferred embodiment of the invention has been described using specific terms, such description is for illustrative purposes only, and it is to be understood that changes and variations may be made without departing from the spirit or scope of the following claims.

What is claimed is:

1. A one-sided sized warp yarn for use in weaving a fabric on a loom comprising:

a plurality of individual yarn fibers oriented generally along the length of said yarn;

a size coating carried on only one side of said yarn;

at least some of said yarn fibers on said one side of said yarn being coated with said size coating;

said size coating being applied to said one side and being dispersed and dissipated from said applied side through the cross-section of said yarn such that at least some of said yarn fibers on the opposite side of said yarn are devoid of any size coating.

2. The yarn of claim 1 wherein said size coating is carried on said fibers of said one side of said yarn bundle generally along the entire length of said yarn.

3. The yarn of claim 1 wherein said size coating on said one side of said yarn is applied and carried at spaced intervals along the length of said yarn creating a spot welding effect at said spaced intervals spaced along said yarn.

4. A one-sided sized warp yarn for use in weaving fabric on a loom comprising:

a plurality of elongated individual yarn fibers oriented generally along the length of said yarn;

a size coating carried on only one side of said yarn applied by pressing a metered amount of size into said one side of said yarn and said size on said fibers of said yarn being present on said one applied side of said yarn and said size diminishing from said applied side through the cross-section of said yarn away from said one side so that at least some of said yarn fibers on the opposite side of said yarn have no size coating thereon.

5. The yarn of claim 4 wherein said size coating is applied to said one side of said yarn by passing said yarn between the nip of an application roll and a pressure roll, applying said metered amount of size to said application roll downstream of said nip, and pressing said metered amount of size into said one side of said yarn without any excess and roll back of sizing on said yarn.

6. The yarn of claim 4 wherein said size coating is carried on said fibers of said one side of said yarn bundle generally along the entire length of said yarn.

7. The yarn of claim 4 wherein said size coating on said one side of said yarn is applied and carried at spaced intervals along the length of said yarn creating a spot welding effect at said spaced intervals spaced along said yarn.

* * * * *